US006604657B2

(12) United States Patent
Yirmiyahu et al.

(10) Patent No.: US 6,604,657 B2
(45) Date of Patent: Aug. 12, 2003

(54) HOLSTER SECURITY DEVICE

(76) Inventors: Benyamin Yirmiyahu, 52 Maimon St., Bnei Brak (IL), 51330; Mordechai Yirmiyahu, 17 Enzio Sereni, Givatayim (IL)

( * ) Notice: Subject to any disclaimer, the term of this patent is extended or adjusted under 35 U.S.C. 154(b) by 0 days.

(21) Appl. No.: 09/758,264

(22) Filed: Jan. 12, 2001

(65) Prior Publication Data

US 2001/0032406 A1 Oct. 25, 2001

Related U.S. Application Data

(60) Provisional application No. 60/175,963, filed on Jan. 13, 2000.

(51) Int. Cl.[7] ..... F41C 33/04

(52) U.S. Cl. ..... 224/243; 42/70.11; 224/911

(58) Field of Search ..... 224/911, 243, 224/192, 193, 912; 42/70.11

(56) References Cited

U.S. PATENT DOCUMENTS

| | | | | | |
|---|---|---|---|---|---|
| 3,866,811 | A | * | 2/1975 | Hamby | 224/244 |
| 4,143,798 | A | | 3/1979 | Perkins | |
| 4,273,276 | A | * | 6/1981 | Perkins | 224/243 |
| 5,127,566 | A | * | 7/1992 | Beletsky | 224/243 |
| 5,199,620 | A | | 4/1993 | Beletsky | |
| 5,322,200 | A | * | 6/1994 | Blanchard | 224/192 |
| 5,518,155 | A | * | 5/1996 | Gallagher | 224/244 |
| 5,551,611 | A | * | 9/1996 | Gilmore | 224/198 |
| 5,581,927 | A | | 12/1996 | Meller | |
| 5,671,560 | A | | 9/1997 | Meller | |
| 5,927,578 | A | | 7/1999 | Kay | |
| 5,946,840 | A | | 9/1999 | Mickel | |
| 5,974,717 | A | | 11/1999 | Brooks | |
| 5,987,796 | A | | 11/1999 | Brooks | |
| 6,085,951 | A | | 7/2000 | Beletsky | |

* cited by examiner

*Primary Examiner*—Stephen P. Garbe
(74) *Attorney, Agent, or Firm*—Edward Langer; Shiboleth, Yisraeli, Roberts, Zisman & Co.

(57) ABSTRACT

A holster security device comprising a latching mechanism which is attached to a holster on a side portion thereof so as to form an integral unit. The device comprises a finger-operated tab extending beyond the housing of the security device and a latch hook which engages a male fastener mounted on a holster safety strap. When the male fastener engages its female counterpart and is aligned with the security device, the strap acts to restrain a firearm. A standard lock and key system is used to provide a high-level of security by locking the moving portions of the safety device and preventing unauthorized removal or theft of a firearm. Another feature of the invention is a trigger safety lock operable in conjunction with a latching mechanism while the firearm is seated in the holster. Optionally, the operation of the safety device parts can be mechanically, electrically, or electronically assisted.

20 Claims, 5 Drawing Sheets

HOLSTER SECURITY DEVICE

CROSS-REFERENCE TO RELATED APPLICATIONS

This application claims priority from and is related to U.S. Provisional Patent Application Ser. No. 60/175,963, filed Jan. 13, 2000, entitled HOLSTER SECURITY DEVICE, the entire disclosure of which is hereby incorporated by reference herein.

FIELD OF THE INVENTION

The present invention relates to holsters for firearms, and in particular, to a holster security device comprising a lock and key mechanism adaptable to existing as well as new holsters to provide personal security and safety.

BACKGROUND OF THE INVENTION

Firearms are presently widely-available, especially in most developed countries, and in particular, among civilians as well as law enforcement agents and military and security personnel. Being so widespread, firearms represent a serious threat to public safety and a danger to children and minors from unauthorized use or accidental discharge.

A common way to prevent unauthorized use or accidental firing of a firearm is to remove an essential operative component, such as the magazine of a pistol, and to keep such a component apart from the firearm itself. However, in such a case, the firearm is not ready for use should a need suddenly arise; moreover, the separated component may get lost or misplaced. This can lead to incurring the cost of replacing the lost or misplaced part or, in some instances, having to replace the entire firearm.

Another known security means for disabling a firearm from firing a cartridge is an add-on locking device mounted on the trigger guard to prevent access to the trigger, such as in U.S. Pat. No. 5,946,840 to Mickel.

In U.S. Pat. No. 5,927,578 to Kay, a standard lock and key is used in a bore-hole in the trigger assembly. The same standard lock can be mounted as part of a holster to prevent inadvertent firing and removal of the firearm.

In the latter two cases, however, in order to enable the firearm for use, the add-on device or lock must be physically removed and placed at a suitable location for ready re-use whenever necessary, which is not only time-consuming and inconvenient, but may also result in the misplacement or loss of the removed device or lock. Also, boring holes in and around the trigger assembly is required. Even for the holster embodiment of the lock mechanism, modification to the trigger assembly is required to accommodate the security device.

U.S. Pat. Nos. 5,987,796 and 5,974,717 to Brooks refer to safety mechanisms fitted in the magazines of firearms, which have the disadvantage of having to modify existing firearms, a practice not always desirable or possible for all varieties of firearms and inexpensive to do.

Other techniques for disabling a firearm known to the art include the insertion of an insert into a firearm's firing chamber or magazine chamber which insert must be withdrawn to enable the firearm to be used. However, an insert into the firing chamber may damage the rifling of the firing chamber. Moreover, such inserts must be separately stored and/or carried by the user, which is not always convenient, and which can also result in the loss or misplacement of the insert.

In U.S. Pat. Nos. 5,671,560 and 5,581,927 to Meller, a spring-operated security device is fitted into the handle of the firearm as an integral part thereof and a key which may easily and conveniently be kept with others normally found on a person, enables or disables firing of the firearm. This construction tends to increase the production cost of the firearm.

In regard to holsters, U.S. Pat. No. 4,143,798 to Perkins features a safety strap for holsters using a fastener ring fastener on the inside surface of the holster for securing the end of the safety strap. However, it does not lock securely or prevent unauthorized withdrawal of the firearm from the holster.

In U.S. Pat. No. No. 5,199,620 to Beletsky, there is described a thumbreak-type holster in which a fastener is mounted on the safety strap of the holster, which can be mated with a securing device on the holster body, to define unlocked and locked positions of the safety strap. An improvement to this design is described in U.S. Pat. No. 6,085,951 to Beletsky et al., where a supplementary latching device such as a sleeve can be slid over the thumbreak, preventing would-be assailants from accessing the thumbreak and removing the firearm. The extra latching device makes quick firearm withdrawal more difficult for the user as well.

Therefore, it would be desirable to provide a security device for a firearm which does not require potentially damaging modifications to the firearm, nor increase its production costs. Furthermore, it would be desirable to provide a convenient, efficient, self-contained, and secure system of locking that cannot be easily defeated or neutralized by unauthorized persons.

SUMMARY OF THE INVENTION

Accordingly, it is a principal object of the present invention to provide a security device easily attached to existing holsters which is operated by a key to lock or release a fastener mounted on the safety strap of the holster, thus locking or releasing a firearm from its holster.

It is an object of the present invention to provide a security device for a firearm having advantages over prior art security devices, as the holster itself serves as a convenient safety pouch for a firearm which, when locked therein, denies access to unauthorized users. and prevents accidental firing of the firearm.

Another object of the invention is to provide a security device which can be used and easily integrated with existing holsters accommodating many different types of firearms, particularly, but not exclusively, handguns such as pistols and revolvers.

A further object of the present invention is to provide a security device that can be used with existing firearms without causing removal of essential parts, placement of add-ons, or making any potentially damaging modifications thereto.

In accordance with a preferred embodiment of the present invention, there is provided a holster security device comprising a security device for receiving a suitable, removable key which operates a typical cylinder lock; a flat, latch hook for engaging and securely holding a fastener mounted on a holster safety strap; a finger-tab, for operating the latch hook, which extends from the retaining ring of the cylinder lock and protrudes in such a manner as to be convenient to the user, but mostly inaccessible or unseen by others. The finger tab is movable to a stop position and optionally, the retaining ring with the latch hook and finger-tab can be locked by a key.

In a preferred embodiment of the invention, the tongue of the holster safety strap is drawn over the rearward portion of a firearm by the insertion motion of the male fastener into a hole provided in the flange of the security device to mate with a female fastener through the flange hole. An end cap seats and houses the cylinder lock retaining ring and allows it to be partially rotated to a stop position provided by a small raised ball-stop on the inside surface of the end cap which engages a matching stop-hole provided in the cylinder lock retaining ring. This ball-stop and stop-hole arrangement provides a low-level of positive locking since the retaining ring and end cap are in surface-to-surface contact and firmly held together in the safety device. The slight physical contact of the ball-stop and stop-hole provides touch-sensitive feedback to indicate to the wearer of the holster when the ring is in a position such that the latch hook is engaged and ready to be locked using the cylinder lock and key.

When the holster safety strap is closed and fastened with the fastener, and the latch hook has been engaged with the fastener in the safety device, yet another level of security is provided to the holster since the firearm cannot be removed unless the latch hook is freed from the strap by the operation of the finger-tab. If, optionally, the cylinder lock and key are not used, the latch hook still provides a high degree of protection for the firearm, while allowing it to be quickly removed by the wearer by a simple motion of a finger on the finger tab which rotates the retaining ring and releases the latch hook from the holster safety strap fastener allowing the strap to be opened and the firearm to be immediately drawn.

The depth of the security device when assembled on its mounting flange is substantially shorter than the transverse dimension of the flange, thereby advantageously providing a relatively flat, compact construction which does not add bulk or much weight to the holster.

The present invention overcomes the disadvantages of the prior art by providing a convenient and inexpensive security device adaptable to existing as well as new holsters for a variety of firearms, without necessitating the removal of any essential operating part of the firearm, the adding-on of removable locks or other safety devices, or requiring any potentially damaging modification to the firearm itself. The invention is based on the advantageous and convenient use of a key and lock system, and does not require expensive or potentially dangerous modifications to a firearm.

Optionally, the holster locking safety device can be operated without locking with a key, yet maintain a higher degree of security against stealthy or unauthorized withdrawal of a firearm than that provided by existing firearm safety devices and commonly used holster safety straps. This is achieved, in a preferred embodiment of the invention, by provision of a latch hook which engages a fastener mounted on a holster strap and is released only with the mechanical operation of a finger-operated tab conveniently mounted on the holster itself. This feature is relatively inexpensive to produce and permits time-saving removal of the firearm by the wearer of the holster in those situations requiring it, while maintaining security of the firearm within its holster.

Additional features and advantages of the invention will be apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1A:
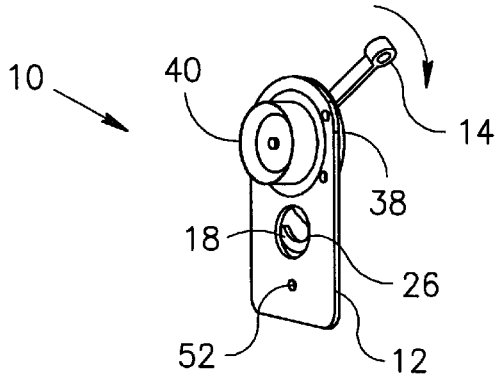
FIG. 1A depicts a general view of a holster security device, constructed and operated in accordance with the principles of the present invention.
Figure 3:
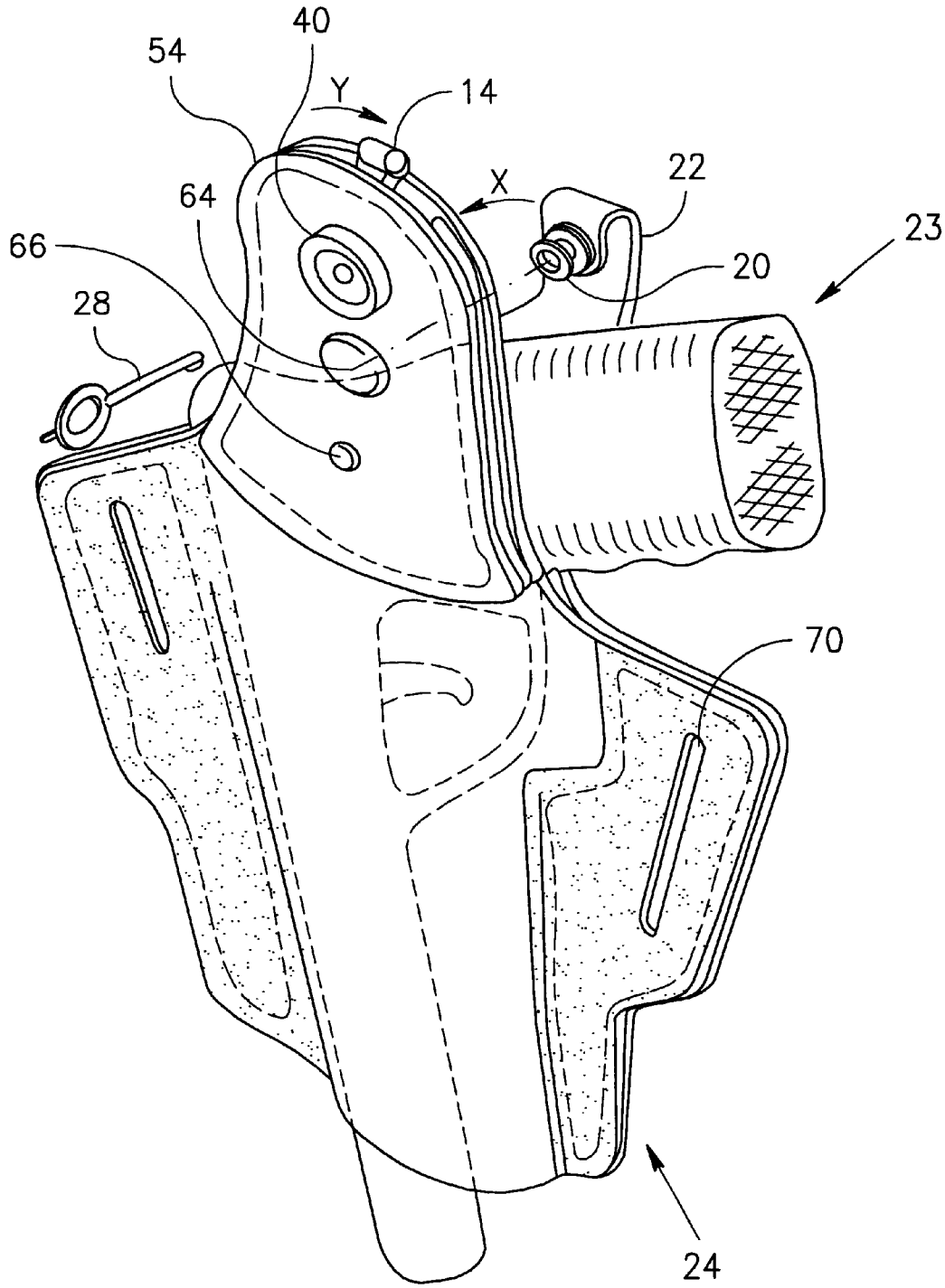
FIG. 3 depicts an isometric view of a typical holster and a firearm seated therein, in accordance with the principles of the present invention.

FIG. 1A depicts a general view of a holster security device 10, constructed and operated in accordance with the principles of the present invention. As shown, security device 10 comprises a mounting flange 12, a finger tab 14 which is integrally formed with a retaining ring 16 (FIG. 1B) which has a latch hook 18 for engaging a male fastener 20 of a holster safety strap 22 (FIG. 3).

Fastener 20 mounted on safety strap 22 is used to secure and retain a firearm 23 in a holster 24, by engaging female receptacle 25 (FIG. 2), thereby providing a first level of safety and security against unauthorized access to or theft of firearm 23 held in holster 24.

In a preferred embodiment of the invention, finger tab 14 protrudes above mounting flange 12 and is used to manually operate latch hook 18, which is shown in the locked position and is visible through a hole 26 in mounting flange 12. In one preferred embodiment of the invention, both finger tab 14 and latch hook 18 are integral to security device 10.

Figure 1B:
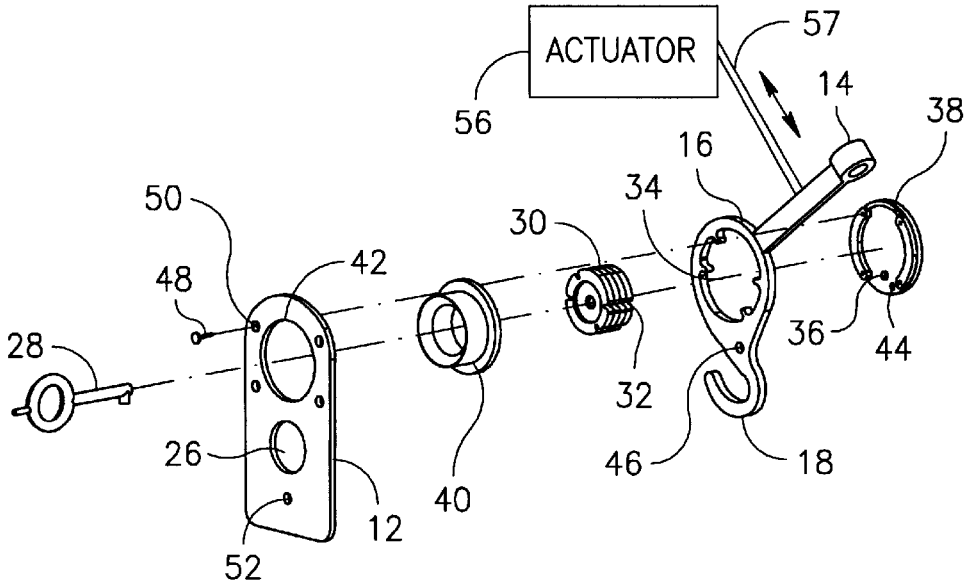
FIG. 1B depicts an exploded isometric view of the security device of FIG. 1A, showing its component parts in relation to one another.

Referring now to FIG. 1B, there is shown an exploded isometric view of the component parts of security device 1O and a typical key 28 for use thereof. Latch hook 18 and finger tab 14 are integral elements of a cylinder lock retaining ring 16 which is configured to fit over commercial cylinder lock 30. Lock 30 serves to restrain rotation of ring 16 about the axis of cylinder lock 30 when key 28 has been turned in the locking position. When cylinder lock 30 is operated by key 28, a pin 32 extends through the cut-out portion 34 of ring 16 and is advanced to insert itself in a matching hole 36 in end cap 38. Cylinder lock 30 is protected and enclosed within a cylinder lock-housing unit 40, a portion of which protrudes through an upper hole 42 of flange 12.

Locking pin 32, when extended into a recess 36 formed in end cap 38, provides additional, positive locking protection since retaining ring 16 is locked in position, and male fastener 20 is thus not removable from the safety device 10 unless unlocked by key 28.

In operation, finger or thumb pressure on tab 14 causes the rotation of tab 14 and rotation of retaining ring 16, so that latch hook 18 engages the shank of holster safety strap fastener 20 (see FIG. 2), when it is inserted into the receptacle of female receptacle 25 through hole 26 in the center of flange 12, to hold it securely within hook 18. This constitutes a second level of safety and security against unauthorized access to firearm 23.

When security device 24 is locked by key 28, finger tab 14 will not operate, as ring 16 cannot be rotated and thus latch hook 18 cannot be released from the narrow shank of fastener 20, and the firearm 23 is thus unable to be drawn from the holster, being primarily restrained by safety strap 22. Thus, the combination of cylinder lock 30 and latch hook 18 provides an even higher level of protection against quick grabs or unauthorized access.

Retaining ring 16 is seated firmly in end cap 38, and thus both parts are in direct surface-to-surface contact during any movement of ring 16. When retaining ring 16 is rotated by operation of finger tab 14, ball-stop 44, which protrudes from the surface of end cap 38, encounters a small stop-hole 46 machined into ring 16. This contact provides touch-sensitive feedback since the adjacent surfaces are in such tight contact that any resistance is immediately felt. This is a convenient and useful way to know when to stop applying pressure on finger tab 14 and when to use key 28 to lock security device 10.

A plurality of fastener means, such as a threaded screw 48, inserted in flange hole 50, is used to hold cylinder lock 30 and its related components securely fixed between end cap 38 and flange 12 to form assembled security device 10. Hole 52 is provided in flange 12 for attaching a protective cover 54 in accordance with the arrangement indicated in FIG. 2.

In an optional modification, the operation of finger-operated tab 14 may be electrically controlled, by an actuator 56, via element 57, which moves tab 14 in response to an actuation signal, thereby causing rotation of retaining ring 16 and latching/unlatching action of latch hook 18, when tab 14 is rotated parallel to the circumference of, and in the plane of, the retaining ring 16.

Figure 1C:
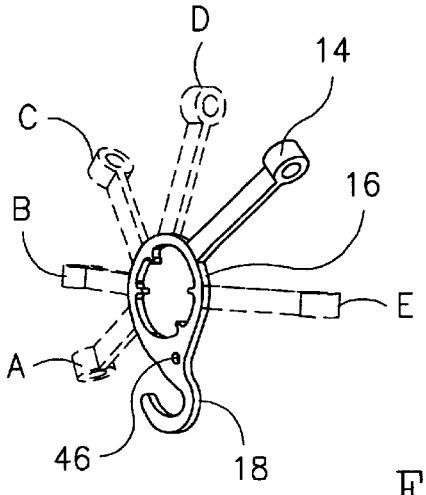
FIG. 1C depicts a number of possible locations where a finger-tab extension to a cylinder lock retaining ring may be suitably connected so as to mechanically operate an attached latch hook in accordance with the principles of the present invention.

FIG. 1C depicts a number of possible locations A–E where a finger-tab 14 may be suitably connected to retaining ring 16 so as to mechanically operate integrally formed latch hook 18 in accordance with the principles of the present invention.

Finger-tab 14 may be of any suitable length for the finger operation, and optionally, it may be constructed to be short and hence of low-profile. With appropriate modification of holster 24, this design reduces the risk of making public the security features incorporated in the holster. Tab 14 in this optional embodiment is less obvious than usual, since its low profile brings it very close to the body of the wearer and hence makes it more difficult for would-be gun snatchers to succeed in finding and operating the finger tab 14 without the direct knowledge of the wearer.

Figure 2:
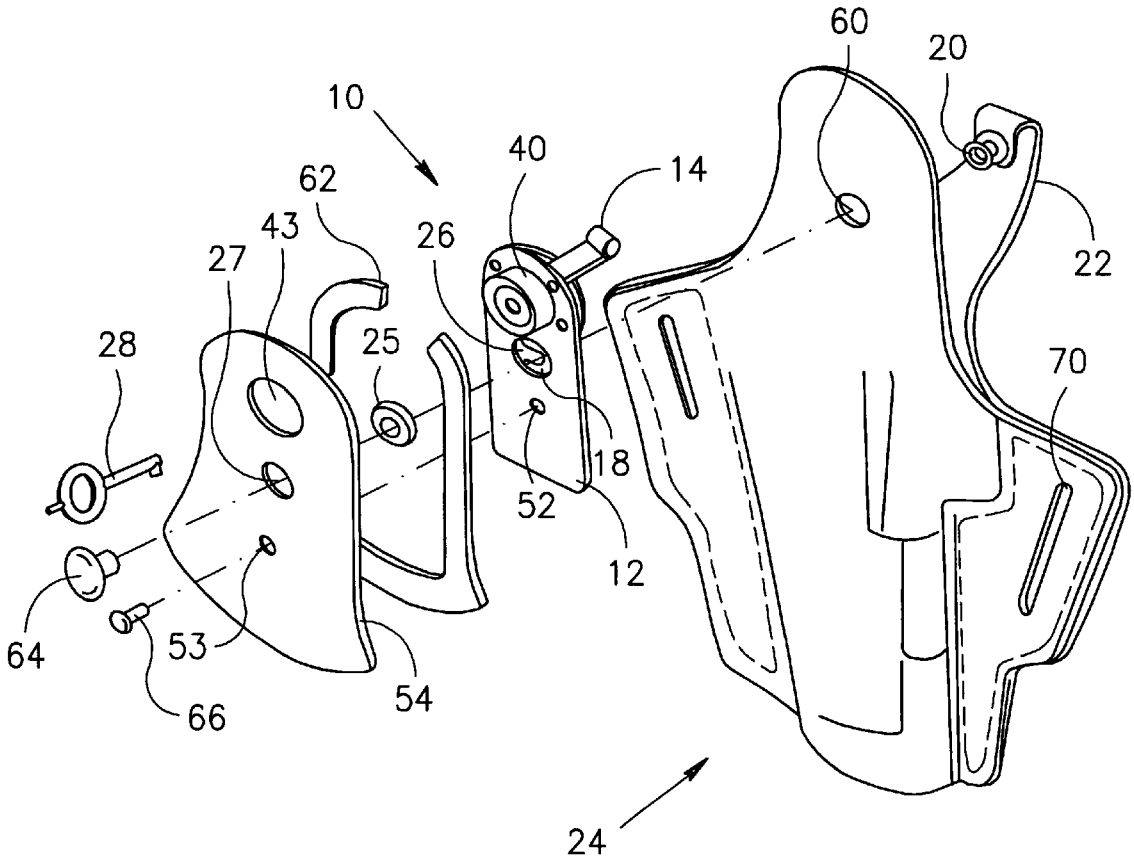
FIG. 2 depicts an exploded isometric view of the assembled security device and other parts of the present invention in relation to their mounting on a typical holster.

FIG. 2 depicts an exploded isometric view of the various components and parts of assembled security device 10 of the present invention, in relation to their mounting in a typical holster 24.

Security device 10, in its assembled form, is placed so as to align fastener hole 60 and flange hole 26 where male fastener 20 and female receptacle 25 meet. Security device 10 is mounted against holster 24 and surrounded by a spacing gasket 62 which is provided with a minimum cut-out portion in its upper perimeter, so as to allow a small degree of freedom of rotation of finger tab 14, slightly above the edge of holster 24, in a preferred embodiment.

Security device 10 is covered by protective cover 54, which may be composed of any suitable material, such as leather, cloth, metal, plastic, or molded rubber, but in a preferred embodiment, cover 54 is made of leather and nylon cloth to match the material used in the construction of holster 24, thus enabling security device 10 to be enclosed by stitching, gluing or any other method known to makers of holsters. A decorative fastener cap 64 is inserted into the hollow space in female receptacle 25 which protrudes through hole 26 provided for this purpose in cover 54, the whole being secured as a unit by the use of a joining rivet 66 which is inserted to pass through cover 54 and joined firmly within hole 68 in flange 12 of security device 10.

The invention is attached to holster 24 on its outer side so as to be accessible for ease of insertion of key 28 when holster 24 is worn on either flank of a wearer. When worn in the usual manner, the holster is usually snugly fitted to the body by a belt (not shown) fitted through slots 70, so that finger tab 14 is also held against the body. This makes it generally difficult for a stranger to see tab 14, even if not of short size, and at the very least, more unlikely that an unauthorized person will succeed in trying to grab the firearm 23 from its holster 24 even when not locked by key 28.

FIG. 3 depicts an isometric view of the operation of security device 10 (not seen) of the present invention using a typical holster 24 and firearm 23 seated therein, highlighting a few of the security and anti-theft features of the present invention.

Male fastener 20 attached to safety strap 22 of holster 24 is drawn over the rearward portion of firearm 23 (arrow "X") which is firmly seated in holster 24, and fastened together with its female receptacle 25 (located under cap 64) where it is held in place by finger tab 14 rotation (arrow "Y") and action of latch hook 18 (shown in FIG. 2) which engages male fastener 20 by its narrow shank. Key 28 is then inserted into the keyhole in cylinder lock 30 which protrudes through the material of protective cover 54 enclosing security device 10. Since safety strap 22 of holster 24 is immovably locked within the security device, unauthorized withdrawal from holster 24 or accidental firing of firearm 23 is effectively prevented. In the preferred embodiment shown, protective cover 54 is stitched to holster 24 to give it a finished appearance.

Rotating key 28 in the opposite direction in lock 30, releases pin 32 from recess 36, and by finger operation of tab 14, latch hook 18 disengages from the shank of male fastener 20, allowing it to be released, thus freeing strap 22 which in turn allows withdrawal of firearm 23.

Optionally, using only the safety strap 22 and latch hook 18, the invention can be operated without locking with key 28, to permit time-saving removal of firearm 23 by the wearer of the holster 24 in those situations requiring it, without sacrificing firearm 23 safety.

Figures 4A, 4B:
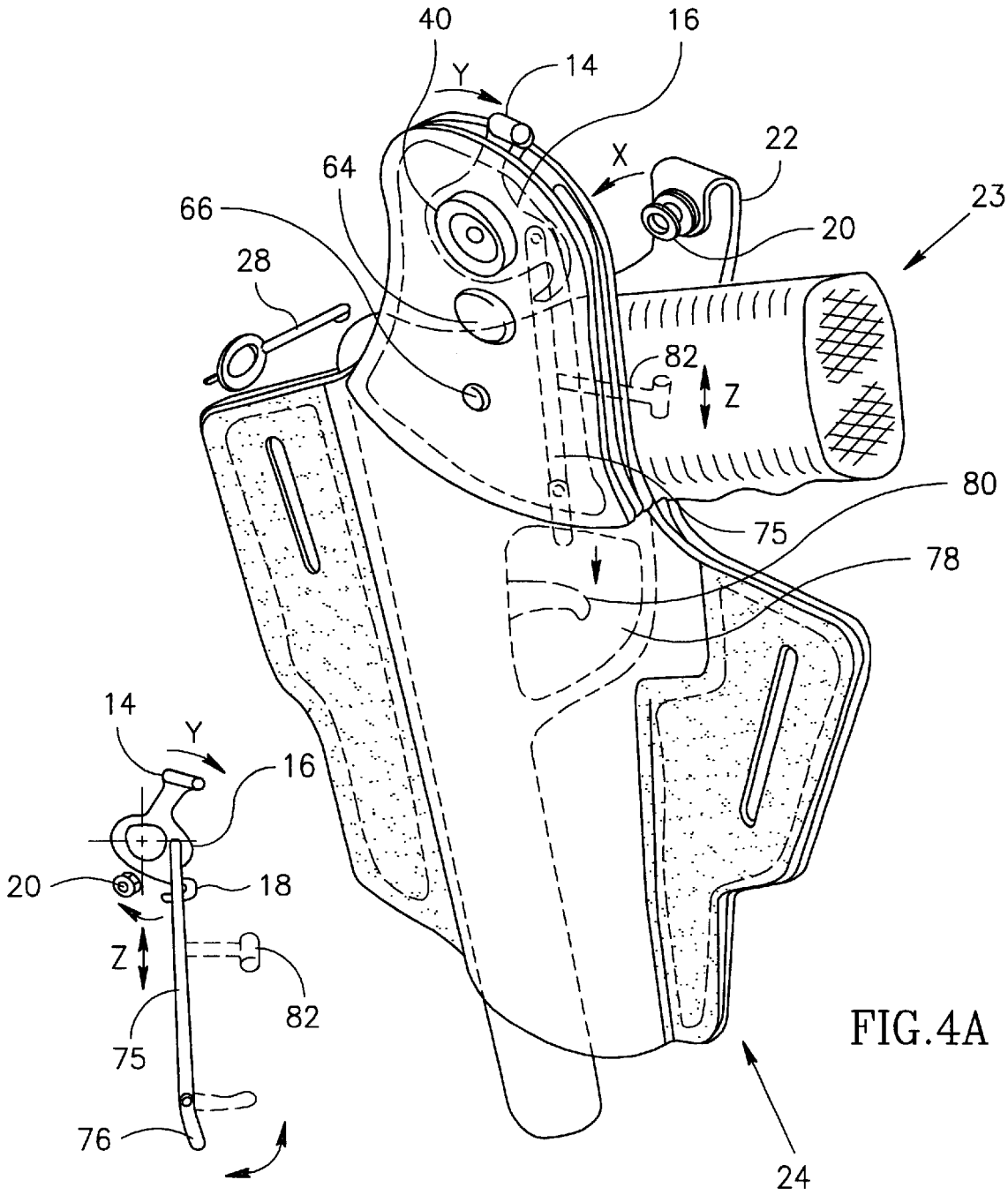
FIGS. 4A–B depict respectively, isometric and detail views of a typical holster, and firearm seated therein, featuring an optional trigger lock feature of the present invention.

Refer ring now to FIGS. 4A–B, there are depicted respectively, isometric and detail views of a typical holster, and firearm seated therein, featuring an optional trigger lock feature of the present invention.

The trigger lock feature is provided by a shaft 75 connected at one end to retaining ring 16, and having an elbow 76 attached to its free end. As shown in the detail view of FIG. 4B, when finger tab 14 is moved downward, retaining ring 16 rotates so that latch hook 18 engages male fastener 20, while the free end of shaft 75 extends downwards into trigger housing 78. Elbow 76 assumes a folded position behind trigger 80, and presents an obstruction to the depression of trigger 80, thereby providing a safety feature against possible attempts to pull trigger 80 while firearm 23 is seated in holster 24.

Alternatively, a lateral finger tab 82 may be attached to shaft 75, to enable downward motion by finger depression (arrow "Z").

Figure 5:
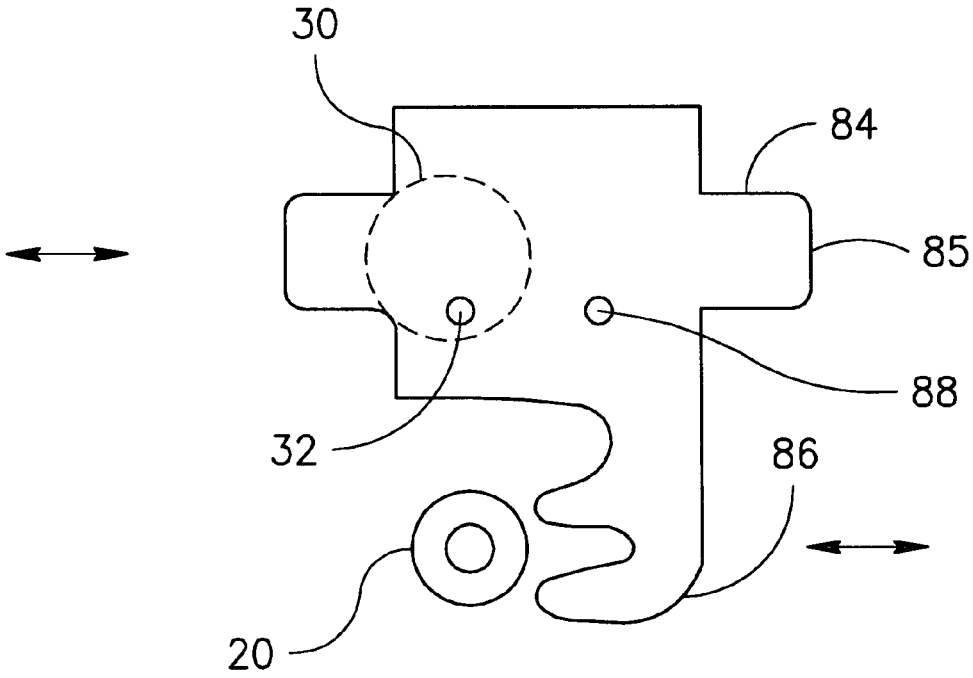
FIG. 5 depicts another preferred embodiment of the present invention showing a holster security device constructed as a flange or sliding plate.

FIG. 5 depicts another preferred embodiment of the present invention showing a slidable flange 84 having finger-operable end tabs 85 extending therefrom. A typically lower portion of flange 84 is formed with a latch hook 86 which engages male fastener 20 of holster safety strap 22. Flange 84 has a hole 88 formed therein to accommodate the extended pin 32 of cylinder lock 30 (mounted behind flange 84) which is used to lock slidable flange 84 in a fixed position in accordance with this preferred embodiment. With appropriate modifications of holster 23, which are within the skill of the art, slidable flange 84 is employed in place of finger tab 14, retaining ring 16, and latch hook 18. The actuator 56 (FIG. 1B) can be adapted in a manner known to those skilled in the art to electromechanically operate slidable flange 84.

Flange 84 may be constructed of any suitable, rigid or semi-rigid material encased within the holster, and operates by moving in a horizontal direction, right or left, so that latch hook 86 located on its lower portion engages and locks onto the shank of male fastener 20. Slidable flange 84 can also be locked in position using cylinder lock 30 as previously described.

Figure 6:
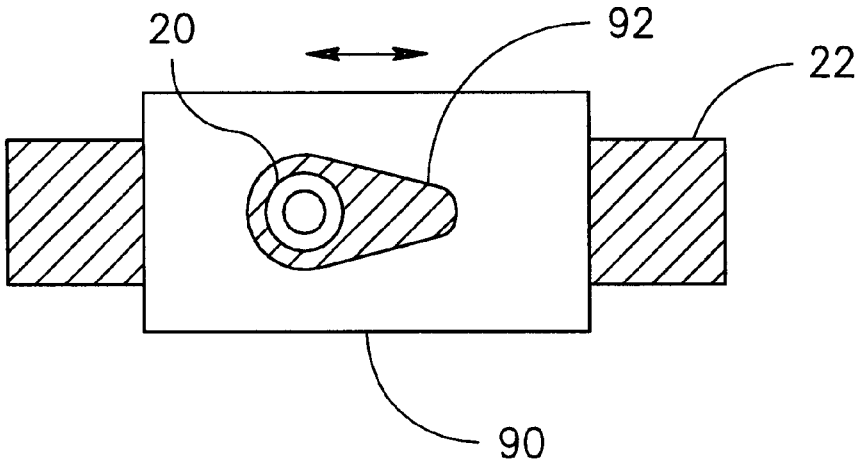
FIG. 6 depicts yet another preferred embodiment of a holster security device, using a horizontally movable latching mechanism with a sliding, clasp-type slot.

FIG. 6 depicts yet another preferred embodiment of a holster security device, using a horizontally movable latching mechanism 90 with a sliding, clasp-type slot 92. With appropriate modifications of holster 23, which are within the skill of the art, latching mechanism 90 is employed in place of finger tab 14, retaining ring 16, and latch hook 18. By sliding motion, latching mechanism 90 engages the shank of male fastener 20 of safety strap 22, thereby restraining safety strap 22, and securing firearm 23 in holster 24 (as per FIG. 3).

When moved in the opposite horizontal direction, the wider end of clasp-type slot 92 moves so as to provide sufficient clearance to permit withdrawal of fastener 20 from slot 92, thereby freeing holster safety strap 22, and enabling withdrawal of firearm 23 from holster 24.

As before, actuator 56 (FIG. 1B) can be adapted in a manner known to those skilled in the art to electromechanically operate latching mechanism 90.

Having described the invention with regard to certain specific embodiments thereof, it is to be understood that the description is not meant as a limitation, since further modifications may now suggest themselves to those skilled in the art, and it is intended to cover such modifications as fall within the scope of the following claims.

We claim:

1. A holster security device for a holster body having a pocket for the insertion and removal of a firearm, and a safety strap attached to the holster body for secure retention of a firearm in the pocket, said device comprising:

fastener means having a shank portion and being mounted on the safety strap;

a matching receptacle fastener means mounted on the holster body; a a cylinder lock mechanism mounted on an end cap and retained in the holster body; and a lock-retaining ring having a tab extending from an upper portion thereof with a latch hook means extending from a lower portion thereof, said retaining ring being lockably rotatable about said cylinder lock mechanism, such that when said fastener means and receptacle fastener means are engaged, said tab is rotatable to engage said latch hook means on said fastener shank portion, to restrain said safety strap from disengagement from the holster body.

2. The device of claim 1 wherein when a key is inserted in said cylinder lock and rotated in a locking mode, a pin extending from said cylinder lock engages a hole provided in said end cap, to restrain the lock-retaining ring in a locked position.

3. The device of claim 1, wherein said security device is enclosed in a side portion of the holster body.

4. The device of claim 1, wherein said tab is finger-operated by 90° rotation about said cylinder lock.

5. The device of claim 1, further comprising an electromechanical actuator arranged to rotate said tab about said cylinder lock in response to an actuation signal.

6. The device of claim 1 wherein said tab is physically connected to an extension of said retaining ring and rotatably engages said latch hook means when said tab is rotated parallel to the circumference of, and in the plane of, said retaining ring.

7. The device of claim 1, further comprising a trigger safety means comprising a shaft connected at one end to said retaining ring, and having connected at its free end an elbow which, in a locked position of said retaining ring, blocks access to the trigger of a firearm.

8. A holster security device for a holster body having a pocket for the insertion and removal of a firearm, and a safety strap attached to the holster body for secure retention of a firearm in the pocket, said device comprising:

fastener means having a shank portion and being mounted on the safety strap;

a matching receptacle fastener means mounted on the holster body;

a cylinder lock mechanism mounted on an end cap and retained in the holster body;

a sliding flange provided with a latch hook engageable with said male fastener, and a ball-shaped protrusion formed on said flange which aligns with a hole formed in said end cap, to provide a tactile sensation when said latch hook is in the locked position, such that when said fastener means and receptacle fastener means are engaged, said latch hook engages said fastener shank portion, to restrain said safety strap from disengagement from the holster body.

9. The device of claim 8 wherein said sliding flange is finger-operable.

10. The device of claim 8 wherein said sliding flange is operable by an electromechanical actuator.

11. A holster security device for a holster body having a pocket for the insertion and removal of a firearm, and a safety strap attached to the holster body for secure retention of a firearm in the pocket, said device comprising:

fastener means having a shank portion and being mounted on the safety strap;

a matching receptacle fastener means mounted on the holster body;

a cylinder lock mechanism mounted on an end cap and retained in the holster body; and a latching mechanism having formed therein a distended hole having narrow and wide ends, said latching mechanism engaging said fastener means shank portion, said fastener means being restrained by sliding action of said narrow end, when said latching mechanism slides into a locking position.

12. The device of claim 8 wherein said latching means is finger-operable.

13. The device of claim 11 wherein said latching mechanism is operable by an electromechanical actuator.

14. A method of securing and locking a firearm in a holster comprising:

providing latching means, a male and female snap-type fastener, and a key and cylinder lock;

strapping said firearm in the holster with a holster safety strap, by inserting said male fastener positioned on said strap into said female fastener mounted on the holster body;

latching said male strap fastener with said latching means; and locking said cylinder lock using said key, by activating a cylinder pin which extends into a receptacle provided in an end-cap of said cylinder lock.

15. The method of claim 14 wherein said latching is provided by a finger-driven rotational motion.

16. The method of claim 14 wherein said latching is provided by a finger-driven sliding motion.

17. The method of claim 14 wherein said latching is assisted by an actuator.

18. The method of claim 17 wherein said actuator is electromechanically operated.

19. The method of claim 17 wherein said actuator is spring-assisted.

20. The method of claim 14 further comprising blocking a trigger of the firearm as a result of the operation of said latching means.

* * * * *